US010427419B2

(12) United States Patent
Ohnishi

(10) Patent No.: US 10,427,419 B2
(45) Date of Patent: Oct. 1, 2019

(54) TEXTILE PRINTING METHOD, DYEING APPARATUS, TEXTILE PRINTING INK, AND TREATMENT INK

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 82 days.

(21) Appl. No.: 15/693,486

(22) Filed: Sep. 1, 2017

(65) Prior Publication Data

US 2018/0065379 A1 Mar. 8, 2018

(30) Foreign Application Priority Data

Sep. 2, 2016 (JP) ..... 2016-172071

(51) Int. Cl.

| | |
|---|---|
| ***B41J 3/407*** | (2006.01) |
| ***B41J 2/01*** | (2006.01) |
| ***D06P 5/20*** | (2006.01) |
| ***B41J 11/00*** | (2006.01) |

(52) U.S. Cl.

CPC ..... *B41J 3/4078* (2013.01); *B41J 2/01* (2013.01); *B41J 11/002* (2013.01); *D06P 5/2005* (2013.01)

(58) Field of Classification Search

CPC .. B41J 3/4078; B41J 2/01; B41J 11/02; D06P 5/2005

See application file for complete search history.

(56) References Cited

U.S. PATENT DOCUMENTS

| | | | | |
|---|---|---|---|---|
| 2002/0065335 | A1* | 5/2002 | Noguchi | C09D 4/00 522/84 |
| 2007/0126831 | A1* | 6/2007 | Suzuki | C08F 220/30 347/100 |
| 2011/0057984 | A1* | 3/2011 | Kuwabara | C09D 11/101 347/20 |

FOREIGN PATENT DOCUMENTS

| | | | | |
|---|---|---|---|---|
| JP | 2006-144180 | * | 6/2006 | D06P 5/00 |
| JP | 2006144180 | | 6/2006 | |

* cited by examiner

*Primary Examiner* — Amina S Khan

(74) *Attorney, Agent, or Firm* — JCIPRNET

(57) ABSTRACT

Provided is a textile printing method that may effectively suppress the risk of ink smearing and that may allow a cured water-soluble, UV-curable resin to be adequately stripped off a fabric so as to dye the fabric in high quality color. A textile printing method includes a pretreatment step of discharging a treatment ink from an inkjet head for treatment toward a fabric to apply the treatment ink to the fabric; a dyeing step of discharging a textile printing ink from an inkjet head for textile printing toward the fabric to apply the textile printing ink to the fabric. In the dyeing step and the pretreatment step, the textile printing ink and the treatment ink are irradiated with ultraviolet light after a respective one of the inks is applied to the fabric.

12 Claims, 4 Drawing Sheets

TEXTILE PRINTING METHOD, DYEING APPARATUS, TEXTILE PRINTING INK, AND TREATMENT INK

CROSS REFERENCE TO RELATED APPLICATIONS

This application claims the priority benefit of Japanese Patent Application No. 2016-172071, filed on Sep. 2, 2016. The entirety of the above-mentioned patent application is hereby incorporated by reference herein and made a part of this specification.

TECHNICAL FIELD

This disclosure relates to a textile printing method, a dyeing apparatus, a textile printing ink, and a treatment ink for use in dyeing fabrics by inkjet printing.

DESCRIPTION OF THE BACKGROUND ART

In some known recording methods, an image is printed on a fabric with inkjet inks for textile printing (for example, Japanese Unexamined Patent Publication No. 2006-144180). The textile printing inkjet ink that may be used in the recording method at least contains a coloring material and a water-soluble compound polymerizable by an external energy line. In the recording method, the inkjet ink for textile printing is discharged and irradiated with an external energy line to polymerize the water-soluble compound into a polymer compound. The textile printing inkjet ink irradiated with an external energy line is increased in viscosity and thus less likely to smear on the fabric. The polymer compound is later washed away with liquid.

SUMMARY

In the known art described in Japanese Unexamined Patent Publication No. 2006-144180, the water-soluble compound added may be increased to more reliably prevent that the textile printing inkjet ink smears on the fabric. A possible issue with an increase of the water-soluble compound added to the textile printing inkjet ink is, that the water-soluble compound that remains after the ink is dried (polymer compound) may lower the proportion of the coloring material to the ink's total quantity. As a result, the coloring material used to dye the fabric may be reduced in concentration. Another possible issue with an increase of the water-soluble compound added to the textile printing inkjet ink is, that the polymer compound generated and cured on the fabric may be entangled with fibers of the fabric and thus difficult to be removed. Removal of any polymer compound left on the fabric, therefore, may be a time-consuming labor. In Japanese Unexamined Patent Publication No. 2006-144180, the proportion of an ultraviolet-polymerizable monomer or oligomer, which is a water-soluble compound, is 5% by weight to the ink's total weight. An insufficiency of the water-soluble compound relative to the ink's total quantity may fail to suppress the risk of ink smearing, and dyeing the fabric in high quality may be difficult to achieve.

This disclosure is directed to providing a textile printing method, a dyeing apparatus, a textile printing ink, and a treatment ink that may effectively suppress the risk of ink smearing and that may allow a cured water-soluble, UV-curable resin to be adequately stripped off a fabric so as to dye the fabric in high quality color.

A textile printing method disclosed herein includes: a dyeing step of discharging a textile printing ink from an inkjet head toward a fabric to apply the textile printing ink to the fabric; and a treatment step of discharging a treatment ink from an inkjet head toward the fabric to apply the treatment ink to the fabric. The treatment step is performed at substantially the same time as the dyeing step. The textile printing ink at least includes: a coloring material; an UV-curable compound polymerizable by ultraviolet light into a water-soluble, UV-curable resin; a readily water-soluble compound added to adjust solubility of the water-soluble, UV-curable resin; and a solvent containing moisture. The treatment ink at least includes: the UV-curable compound; the readily water-soluble compound; the solvent; and an auxiliary added to facilitate a process to dye the fabric using the coloring material. The dyeing step further includes irradiating the textile printing ink applied to the fabric with ultraviolet light. The treatment step further includes irradiating the treatment ink applied to the fabric with ultraviolet light.

The textile printing ink and the treatment ink both contain the readily water-soluble compound. The proportion of the UV-curable compound in a respective one of these inks may desirably be increased. Yet, the water-soluble, UV-curable resin obtained from this compound and cured may be adequately stripped off the fabric. Therefore, the proportion of the UV-curable compound in a respective one of these inks, which will be later polymerized into the water-soluble, UV-curable resin, can optionally be increased, and the inks, by being irradiated with ultraviolet light, may be increased in viscosity and thus less likely to smear on the fabric. In the treatment step, the auxiliary added to the treatment ink may help to adequately fix the coloring material to the fabric. As a result, the fabric may be dyed in high quality color. Examples of the coloring material may include dyes and pigments. In the dyeing step and the treatment step, the textile printing ink and the treatment ink are applied to the fabric by the inkjet heads. These steps, therefore, may be efficiently carried out online. Examples of the moisture-containing solvent may include water, solvents containing water, and solvents containing moisture.

The treatment step may be a pretreatment step preceding the dyeing step.

By performing these steps in this order, the treatment ink is first applied to the fabric, and the textile printing ink is then discharged onto the treatment ink. The treatment ink spread earlier on the fabric may prevent the textile printing ink from smearing on the fabric, and the auxiliary of the treatment ink may facilitate the process to dye the fabric using the coloring material of the textile printing ink.

The textile printing ink may include the UV-curable compound in a proportion from 20% to 60% by weight to a total weight of the textile printing ink.

The textile printing ink containing the UV-curable compound in a proportion of 20% or more by weight to the ink's total weight may have a degree of viscosity at which smearing of the textile printing ink on the fabric is adequately controllable. In the textile printing ink containing the UV-curable compound in a proportion of 60% or less by weight to the ink's total weight, the proportion of the coloring material may be increased. As a result, the coloring material on the fabric may be increased in concentration, and the fabric may be accordingly dyed in high quality color. As with the textile printing ink, the treatment ink may include the UV-curable compound in a proportion from 20% to 60% by weight to a total weight of the treatment ink.

The textile printing ink or the treatment ink may include the readily water-soluble compound in a proportion from 10% to 50% by weight to a total weight of the textile printing ink or the treatment ink.

By having the proportion of the readily water-soluble compound in the textile printing ink or the treatment ink adjusted to stay in this range, solubility of the cured water-soluble, UV-curable resin may be suitably adjustable.

The treatment ink may include the auxiliary in a proportion from 5% to 70% by weight to a summed weight of the UV-curable compound and the readily water-soluble compound.

By having the proportion of the auxiliary in the treatment ink adjusted to stay in this range, the coloring material may be adequately fixed to the fabric.

The textile printing ink may include the coloring material in a proportion from 10% to 200% by weight to a summed weight of the UV-curable compound and the readily water-soluble compound after the textile printing ink is dried.

By having the proportion of the coloring material in the textile printing ink adjusted to stay in this range, the coloring material may have a concentration at which the fabric is dyed in high quality color.

The method may further include a heating step of heating the textile printing ink and the treatment ink on the fabric to evaporate the solvents included in the textile printing ink and the treatment ink.

The inks may be further increased in viscosity by evaporating the solvents. This may more effectively suppress the risk of ink smearing. The heating step may be performed at a point in time, at least one selected from: at the same time as the dyeing step and the treatment step; prior to the dyeing step and the treatment step; and subsequent to the dyeing step and the treatment step.

A dyeing apparatus disclosed herein includes: an inkjet head for textile printing from which a textile printing ink is discharged toward a fabric; an inkjet head for treatment from which a treatment ink is discharged toward the fabric; an ultraviolet irradiator that irradiates the textile printing ink and the treatment ink with ultraviolet light; and a heater that heats the textile printing ink and the treatment ink on the fabric. The textile printing ink at least includes: a coloring material; an UV-curable compound polymerizable by ultraviolet light into a water-soluble, UV-curable resin; a readily water-soluble compound added to adjust solubility of the water-soluble, UV-curable resin; and a solvent containing moisture. The treatment ink at least includes: the UV-curable compound; the readily water-soluble compound; the solvent; and an auxiliary added to facilitate a process to dye the fabric using the coloring material. The ultraviolet irradiator irradiates the textile printing ink with ultraviolet light after the textile printing ink is discharged onto the fabric. The ultraviolet irradiator irradiates the treatment ink with ultraviolet light after the treatment ink is discharged onto the fabric. The heater evaporates the solvents included in the textile printing ink and the treatment ink.

The textile printing ink and the treatment ink both contain the readily water-soluble compound. The proportion of the UV-curable compound in a respective one of these inks may desirably be increased. Yet, the water-soluble, UV-curable resin obtained from this compound and cured may be adequately stripped off the fabric. Therefore, the proportion of the UV-curable compound in a respective one of these inks can optionally be increased, and the inks, by being irradiated with ultraviolet light, may be increased in viscosity and thus less likely to smear on the fabric. The auxiliary added to the treatment ink may help to adequately fix the coloring material to the fabric. As a result, the fabric may be dyed in high quality color. The textile printing ink and the treatment ink are respectively applied to the fabric by the inkjet head for textile printing and the inkjet head for treatment. The dying step and the treatment step, therefore, may be efficiently carried out online. Examples of the moisture-containing solvent may include water, solvents containing water, and solvents containing moisture.

A textile printing ink disclosed herein is for use in dying a fabric. The textile printing ink at least includes: a coloring material; an UV-curable compound polymerizable by ultraviolet light into a water-soluble, UV-curable resin; a readily water-soluble compound added to adjust solubility of the water-soluble, UV-curable resin; and a solvent containing moisture.

The textile printing ink thus contains the readily water-soluble compound. The proportion of the UV-curable compound in the textile printing ink may desirably be increased. Yet, the readily water-soluble compound added to this ink may allow the cured water-soluble, UV-curable resin to be adequately stripped off the fabric. Therefore, the proportion of the UV-curable compound in the textile printing ink can optionally be increased, and the textile printing ink, by being irradiated with ultraviolet light, may be increased in viscosity and thus less likely to smear on the fabric. Examples of the coloring material may include dyes and pigments.

A treatment ink disclosed herein is for use in treatment of a fabric to be dyed. The treatment ink at least includes: an UV-curable compound polymerizable by ultraviolet light into a water-soluble, UV-curable resin; a readily water-soluble compound added to adjust solubility of the water-soluble, UV-curable resin; a solvent containing moisture; and an auxiliary added to facilitate a process to dye the fabric.

The treatment ink thus contains the readily water-soluble compound. The proportion of the UV-curable compound in the textile printing ink may desirably be increased. Yet, the readily water-soluble compound added to this ink may allow the cured water-soluble, UV-curable resin to be adequately stripped off the fabric. Therefore, the proportion of the UV-curable compound in the treatment ink can optionally be increased, and the treatment ink, by being irradiated with ultraviolet light, may be increased in viscosity. The treatment ink, if spread below the textile printing ink, may effectively prevent that the textile printing ink later discharged smears on the fabric. The auxiliary added to the treatment ink may help to adequately fix the coloring material of the textile printing ink to the fabric. As a result, the fabric may be dyed in high quality color.

DETAILED DESCRIPTION OF EMBODIMENTS

An embodiment of this disclosure is hereinafter described in detail referring to the accompanying drawings. It should be understood that the scope of this disclosure is not limited by the embodiment. The technical features described in the embodiment may include any means easily replaceable by those skilled in the art and substantially identical means. The technical features hereinafter described may be suitably combined, or more than one example presented herein may be combined.

Embodiment

In a textile printing method and a dyeing apparatus 10 according to this embodiment, inkjet printing is employed to dye a fabric 1. The textile printing method and the dyeing apparatus 10 are described referring to FIGS. 1 to 4.

Figure 1:
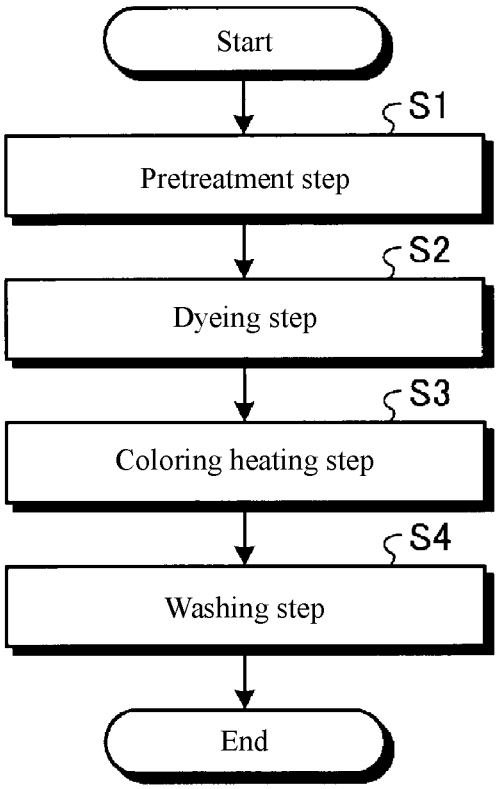
FIG. 1 is a flow chart of a textile printing method according to an embodiment.
Figure 2:
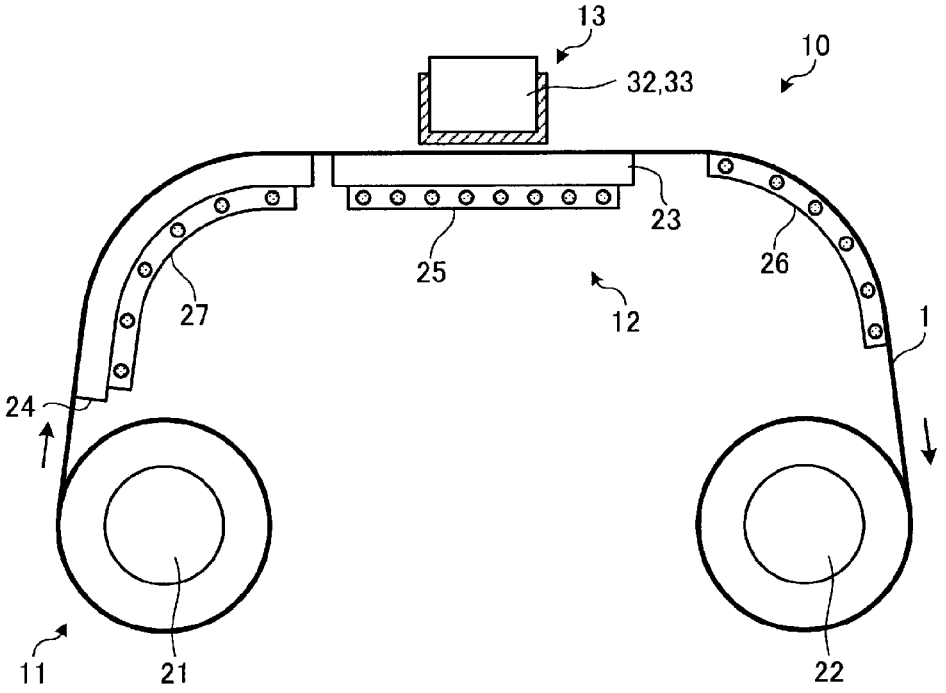
FIG. 2 is an illustrative drawing of a dyeing apparatus according to the embodiment.
Figure 3:
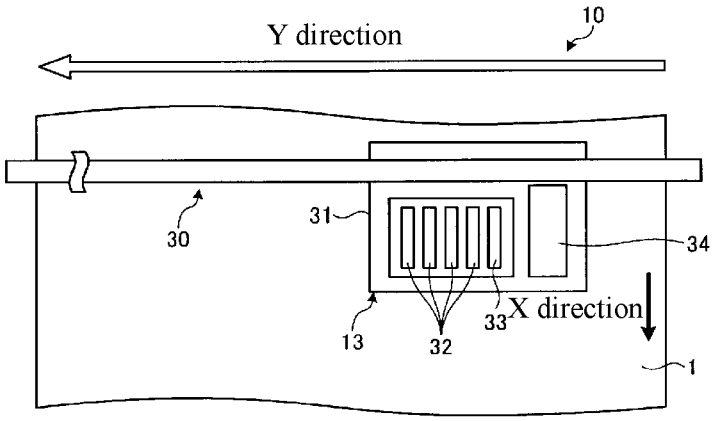
FIG. 3 is a schematic plan view of the dyeing apparatus.
Figure 4:
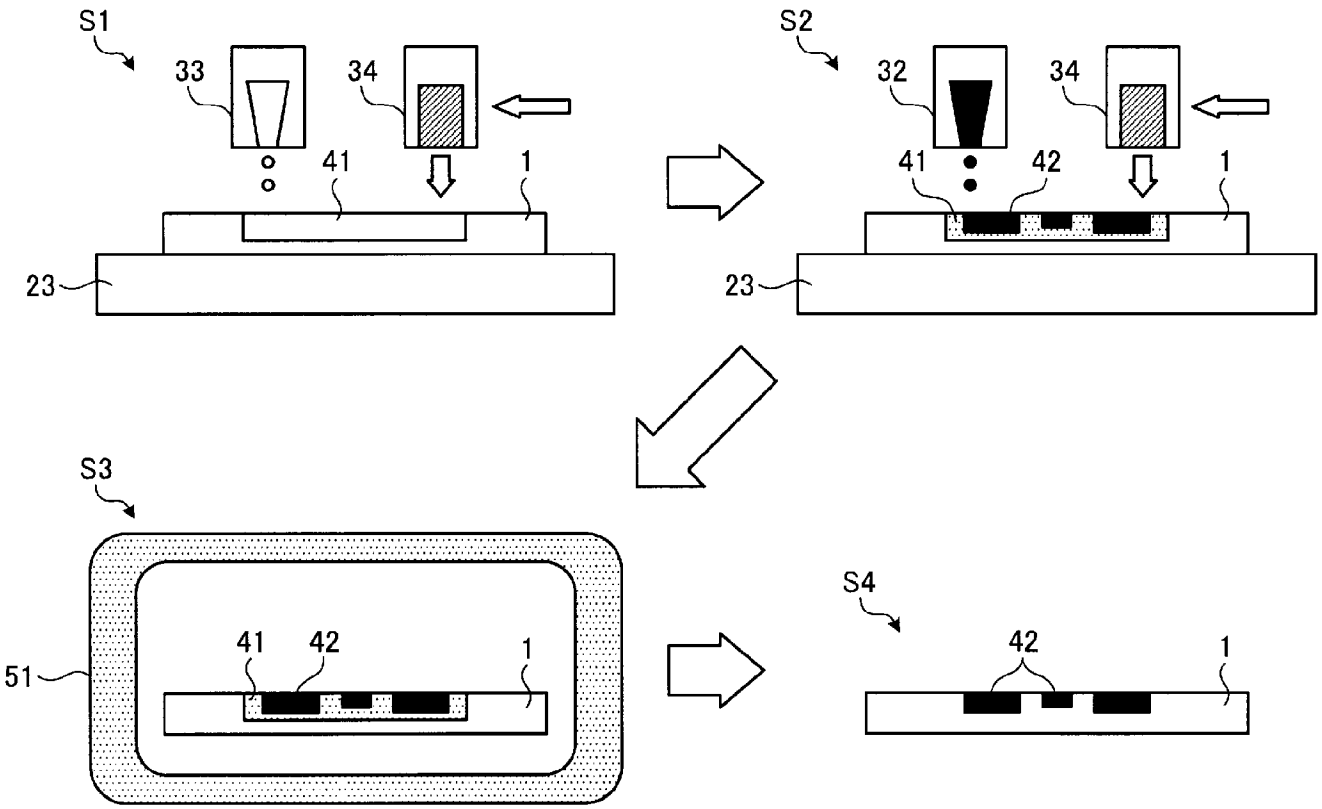
FIG. 4 is an illustrative drawing of the textile printing method.

FIG. 1 is a flow chart of the textile printing method. FIG. 2 is an illustrative drawing of the dyeing apparatus. FIG. 3 is a schematic plan view of the dyeing apparatus. FIG. 4 is an illustrative drawing of the textile printing method.

In advance of describing the textile printing method, the dyeing apparatus 10 is described referring to FIGS. 2 and 3. In the dyeing apparatus 10, textile printing inks are discharged from inkjet heads toward a fabric 1 fed by the Role-to-Role method and applied to the fabric 1, as illustrated in FIGS. 2 and 3. The dyeing apparatus 10 has a fabric feeder 11, a heater 12, and an inkjet device 13.

The fabric feeder 11 has a feed roller 21, a take-up roller 22, a platen 23, and a guide 24. The feed roller 21 feeds the fabric 1 wound around on this roller. The fabric 1 unwound from the feed roller 21 is fed through the guide 24 toward the platen 23. The take-up roller 22 rolls up and collects the dyed fabric 1. The fabric 1 dyed on the platen 23 moves toward and collected by the take-up roller 22. The platen 23 is situated so as to face the inkjet device 13. The surface of the platen 23 that contacts the fabric 1 is a flat surface. The fabric 1 is subjected to treatment performed by the inkjet device 13 on the platen 23. The guide 24 is disposed at a position on the transport path of the fabric 1 between the feed roller 21 and the platen 23. The guide 24 guides the fabric 1 from the feed roller 21 to the platen 23.

This embodiment provides the fabric feeder 11 operated by the Role-to-Role method. This is, however, a non-limiting example. The fabric feeder 11 operable to feed the fabric 1 for inkjet printing may be configured otherwise.

The heater 12 heats the fabric 1 unwound from the fabric feeder 11. The heater 12 has a platen heating unit 25, an after-heating unit 26, and a preheating unit 27. The platen heating unit 25 heats the platen 23 to heat the fabric 1 moving on the platen 23. The preheating unit 27 heats the guide 24 to heat the fabric 1 moving on the guide 24. The after-heating unit 26 is disposed at a position on the transport path of the fabric 1 between the platen 23 and the take-up roller 22. The after-heating unit 26 heats the fabric 1 transported from the platen 23.

The inkjet device 13 is facing the platen 23 on the opposite side of the platen 23 across the fabric 1. The inkjet device 13 has a carriage 30, a base 31, a plurality of inkjet heads for textile printing 32, an inkjet head for treatment 33, and an ultraviolet irradiator 34. Here, X direction refers to the transport direction of the fabric 1, and Y direction refers to a direction orthogonal to the X direction. The inkjet device 13 moves the inkjet heads 32 and 33 for scan in the Y direction within the plane of the platen 23.

The carriage 30 extends in the Y direction so as to guide the inkjet heads 32 and 33 to move in the Y direction. The base 31 is disposed on the carriage 30 and is driven to move in the Y direction by a drive source not illustrated in the drawings. The inkjet heads for textile printing 32 are disposed on the base 31. These inkjet heads discharge the textile printing inks onto the fabric 1. The number of the inkjet heads 32 for textile printing depends on the number of color inks desirably used. For example, four inkjet heads 32 for CMYK colors may be arranged in the Y direction. The inkjet head for treatment 33 is disposed on the base 31. This inkjet head discharges a treatment ink onto the fabric 1. The inkjet head for treatment 33 is adjacent to the inkjet heads for textile printing 32 in the Y direction. The ultraviolet irradiator 34 is disposed on the base 31. The ultraviolet irradiator 34 irradiates the textile printing inks and the treatment ink on the fabric 1 with ultraviolet light. The ultraviolet irradiator 34 is adjacent to the inkjet head for treatment 33 in the Y direction.

The inkjet device 13 discharges the inks unidirectionally from one side to the other side in the Y direction. The inkjet heads for textile printing 32 are located ahead of the ultraviolet irradiator 34 in the Y direction, the ultraviolet irradiator 34 is located backward in the Y direction, and the inkjet head for treatment 33 is interposed between the ultraviolet irradiator 34 and the group of inkjet heads for textile printing 32.

In this embodiment, one base is mounted with the inkjet heads 32 for textile printing, inkjet head for treatment 33, and ultraviolet irradiator 34. This is, however, a non-limiting example. Instead, more than one carriage 30 may be used, so that the inkjet heads 32 for textile printing, inkjet head for treatment 33, and ultraviolet irradiator 34 are allowed to move independently.

The textile printing ink used in the inkjet head for textile printing 32 is described below. The textile printing ink at least includes a coloring material, an UV-curable compound polymerizable by ultraviolet light into a water-soluble, UV-curable resin, a readily water-soluble compound added to adjust solubility of the water-soluble, UV-curable resin, and a solvent containing moisture.

Examples of the coloring material may include dyes and pigments. Examples of the UV-curable compound polymerized into the water-soluble, UV-curable resin may include water-soluble monomers and oligomers. Examples of the readily water-soluble compound may include water-soluble starches, sheet-like, water-soluble adhesives, sodium alginate, and synthetic adhesives. Examples of the moisture-containing solvent may include water, solvents containing water, and solvents containing moisture.

The textile printing ink contains the UV-curable compound in a proportion from 20% to 60% by weight to the ink's total weight. The textile printing ink containing the UV-curable compound in a proportion of 20% or more by weight to the ink's total weight may have a degree of viscosity at which smearing of the textile printing ink on the fabric after ultraviolet irradiation is adequately controllable. In the textile printing ink containing the U V-curable compound in a proportion of 60% or less by weight to the ink's total weight, the proportion of the coloring material may be increased. As a result, the coloring material on the fabric 1 may be increased in concentration.

The textile printing ink contains the readily water-soluble compound in a proportion from 10% to 50% by weight to the ink's total weight. By having the proportion of the readily water-soluble compound adjusted to stay in this range, solubility of the cured water-soluble, UV-curable resin may be adequately controllable.

The textile printing ink contains the coloring material in a proportion from 10% to 200% by weight to a summed weight of the UV-curable compound and the readily water-soluble compound after the textile printing ink is dried. By having the proportion of the coloring material adjusted to stay in this range, the coloring material may have a concentration at which the fabric 1 is dyed in high quality color. The coloring material, UV-curable compound, and readily water-soluble compound are adjusted to meet the respective ranges. Then, the proportion of the solvent is suitably adjusted.

Examples are given below as to the proportions of the coloring material, UV-curable compound, readily water-soluble compound, and solvent in the textile printing ink.

Example 1

UV-curable compound: 30% by weight
Readily water-soluble compound: 20% by weight
Coloring material: 10% by weight
Solvent: 40% by weight Example 2

UV-curable compound: 30% by weight
Readily water-soluble compound: 10% by weight
Coloring material: 10% by weight
Solvent: 50% by weight The treatment ink used in the inkjet head for treatment 33 is described below. The treatment ink at least includes an UV-curable compound polymerizable by ultraviolet light into a water-soluble, UV-curable resin, a readily water-soluble compound added to adjust solubility of the water-soluble, UV-curable resin, a solvent containing moisture, and an auxiliary added to facilitate the process to dye the fabric (coloring auxiliary).

The UV-curable compound polymerized by ultraviolet light into the water-soluble, UV-curable resin, readily water-soluble compound, and solvent of the treatment ink are similar to the materials of the textile printing ink, which will not be described again. Examples of the auxiliary may include surface active agents, pH adjusters, and mordants.

The treatment ink contains the UV-curable compound in a proportion from 20% to 60% by weight to the ink's total weight, as with the textile printing ink. The treatment ink contains the readily water-soluble compound in a proportion from 10% to 50% by weight to the ink's total weight, as with the textile printing ink.

The treatment ink contains the auxiliary in a proportion from 5% to 70% by weight to a summed weight of the UV-curable compound and the readily water-soluble compound. By having the proportion of the auxiliary adjusted to stay within the range, the coloring material may be adequately fixed to the fabric. As with the textile printing ink, the proportion of the solvent is suitably adjusted after the auxiliary, UV-curable compound, and readily water-soluble compound are adjusted to meet the respective ranges.

An example is given below as to the proportions of the UV-curable compound, readily water-soluble compound, solvent, and auxiliary in the treatment ink.

Example 1

UV-curable compound: 20% by weight
Readily water-soluble compound: 15% by weight
Auxiliary: 15% by weight
Solvent: 50% by weight As described earlier, the proportion of the UV-curable compound differs between the textile printing ink and the treatment ink. The textile printing ink contains the UV-curable compound in a greater proportion than the treatment ink, which may be rephrased that the treatment ink contains the UV-curable compound in a smaller proportion than the textile printing ink. This is because no precaution may be necessary against smearing of the colorless treatment ink containing no coloring material, and the treatment ink, even if it smears on the fabric, will be removed in a washing step described later. The proportion of the auxiliary in the treatment ink, therefore, may be increased in accordance with the coloring material of the textile printing ink. The proportion of the coloring material in the textile printing ink may be suitably decided in consideration of reactions of the coloring material with fibers of the fabric 1 and the auxiliary that may facilitate the reactions.

The textile printing method according to this embodiment is described below referring to FIGS. 1 to 4. The textile printing method includes a pretreatment step S1, a dyeing step S2, a coloring heating step S3, and a washing step S4, which are carried out in the mentioned order. This method further includes a heating step. The heating step is performed prior to the pretreatment step S1 and the dyeing step S2, at the same time as the pretreatment step S1 and the dyeing step S2, and subsequent to the pretreatment step S1 and the dyeing step S2.

Prior to the pretreatment step S1 and the dyeing step S2, the heating step heats the guide 24 using the preheating unit 27 of the heater 12 to preheat the fabric 1. This preheating may accelerate evaporation of the solvents in the treatment ink and the textile printing ink on the fabric 1. At the same time as the pretreatment step S1 and the dyeing step S2, the heating step heats the platen 23 using the platen heating unit 25 of the heater 12 to heat the fabric 1. This heating may further accelerate evaporation of the solvents in the treatment ink and the textile printing ink on the fabric 1. Subsequent to the pretreatment step S1 and the dyeing step S2, the heating step heats the fabric 1 using the preheating unit 27 of the heater 12. This may even further accelerate evaporation of the solvents in the treatment ink and the textile printing ink on the fabric 1.

In the pretreatment step S1, the treatment ink is discharged from the inkjet head for treatment 33 toward the fabric 1 and applied to the fabric 1. In the pretreatment step S1, the inkjet head for treatment 33 and the ultraviolet irradiator 34 are moved for scan in the Y direction, and the treatment ink is discharged from the inkjet head for treatment 33 onto the fabric 1, as illustrated in FIG. 4. In the pretreatment step S1, the discharged treatment ink is then irradiated with ultraviolet light radiated from the ultraviolet irradiator 34 to form a pretreatment layer 41 on the fabric 1. The pretreatment layer 41 is formed in a greater area than an image dyed and formed later on the fabric 1.

The pretreatment step S1 irradiates the treatment ink with ultraviolet light to polymerize the UV-curable compound of the treatment ink into the water-soluble, UV-curable resin, so that the treatment ink is increased in viscosity. The heating step is performed by the heater 12 at the same time as the pretreatment step S1 to evaporate the solvent of the treatment ink, so that the treatment ink is further increased in viscosity.

In the dyeing step S2, the textile printing inks are discharged from the inkjet heads for textile printing 32 toward the fabric 1 and applied to the fabric 1. In the dyeing step S2, the inkjet heads for textile printing 32 and the ultraviolet irradiator 34 are moved for scan in the Y direction, and the textile printing inks are discharged from the inkjet heads for textile printing 32 onto the pretreatment layer 41 formed on the fabric 1, as illustrated in FIG. 4. In the dyeing step S2, the discharged textile printing inks are then irradiated with ultraviolet light radiated from the ultraviolet irradiator 34 to form a dyed layer 42 on the pretreatment layer 41 already formed on the fabric 1. The dyed layer 42 is formed in an area smaller than the pretreatment layer 41. Then, any unnecessary components are removed from the dyed layer 42 to form a dyed image.

The dyeing step S2 irradiates the textile printing inks with ultraviolet light to polymerize the UV-curable compound of the textile printing inks into the water-soluble, UV-curable resin, so that the textile printing inks are increased in viscosity. The heating step is performed by the heater 12 at the same time as the dyeing step S2 to evaporate the solvent in the textile printing inks, so that the textile printing inks are further increased in viscosity.

The pretreatment step S1 and the dyeing step S2 are a sequence of steps carried out online by the dyeing apparatus 10.

In the coloring heating step S3, the dyed fabric 1 is heated in a heating chamber 51, so that color production of the coloring material occurs through reactions with fibers of the fabric 1.

In the washing step S4, any unnecessary components (residue) of the pretreatment layer 41 (treatment ink) and the dyed layer 42 (textile printing ink) formed on the fabric 1 are removed by soaping or cleaning liquid. Examples of the cleaning liquid may include lukewarm water, hot water, soap water, acid water, and alkali water. The unnecessary components removed from the pretreatment layer 41 and the dyed layer 42 in the washing step S4 are the water-soluble, UV-curable resin, readily water-soluble compound, auxiliary, unevaporated solvent, and unreacted coloring material.

In this embodiment, the textile printing ink and the treatment ink both contain the readily water-soluble compound. When the proportion of the UV-curable compound in a respective one of these inks is increased, the water-soluble, UV-curable resin obtained from this compound and cured may be adequately stripped off the fabric 1. Therefore, the proportion of the UV-curable compound in a respective one of these inks can optionally be increased, and the inks, by being irradiated with ultraviolet light, may be increased in viscosity and thus less likely to smear on the fabric. In the pretreatment step S1, the auxiliary added to the treatment ink may help to adequately fix the coloring material to the fabric. As a result, the fabric may be dyed in high quality color. In the pretreatment step S1 and the dyeing step S2, the textile printing inks and the treatment ink are respectively applied to the fabric 1 by the inkjet heads for textile printing 32 and the inkjet head for treatment 33. The dying step S1 and the treatment step S2, therefore, may be efficiently carried out online.

In this embodiment, the treatment ink is first applied to the fabric 1, and the textile printing inks are then discharged onto the treatment ink (pretreatment layer 41). The treatment ink spread earlier on the fabric 1 may prevent the textile printing inks from smearing on the fabric, and the auxiliary of the treatment ink may facilitate the process to dye the fabric using the coloring material of the textile printing ink.

In this embodiment, the textile printing ink containing the UV-curable compound in a proportion of 20% or more by weight to the ink's total weight may have a degree of viscosity at which smearing of the textile printing ink on the fabric 1 is adequately controllable. In the textile printing ink containing the UV-curable compound in a proportion of 60% or less by weight to the ink's total weight, the proportion of the coloring material may be increased. As a result, the coloring material on the fabric may be increased in concentration, and the fabric may be accordingly dyed in high quality color.

In this embodiment, the textile printing ink or the treatment ink contains the readily water-soluble compound in a proportion from 10% to 50% by weight to the ink's total weight. This may allow solubility of the cured water-soluble, UV-curable resin to be suitably adjustable.

In this embodiment, the treatment ink contains the auxiliary in a proportion from 5% to 70% by weight to a summed weight of the UV-curable compound and the readily water-soluble compound. This may allow the coloring material to be adequately fixed.

In this embodiment, the textile printing ink contains the coloring material in a proportion from 10% to 200% by weight to a summed weight of the UV-curable compound and the readily water-soluble compound after the textile printing ink is dried. This may allow the coloring material to be suitably adjusted in concentration.

In this embodiment, the inks may be further increased in viscosity by having the solvent of each ink evaporated by the heater 12. This may further effectively suppress the risk of ink smearing.

While this embodiment provides the heater 12 having the platen heating unit 25, after-heating unit 26, and preheating unit 27, the heater 12 may be at least equipped with any one of these heating units.

In this embodiment, the fabric 1 is dyed by the inkjet device 13 by feeding the fabric 1. Instead, the inkjet device 13 may be moved in the sub scanning direction and scanning direction to dye the fabric 1 set on the platen 23.

The auxiliary added to the treatment ink in this embodiment may instead be added to the textile printing ink.

What is claimed is:

1. A textile printing method, comprising:

a dyeing step of discharging a textile printing ink from an inkjet head toward a fabric to apply the textile printing ink to the fabric; and a treatment step of discharging a treatment ink from an inkjet head toward the fabric to apply the treatment ink to the fabric, the treatment step being performed at substantially the same time as the dyeing step, the textile printing ink at least including a coloring material; an UV-curable compound polymerizable by ultraviolet light into a water-soluble, UV-curable resin; a readily water-soluble compound added to adjust solubility of the water-soluble, UV-curable resin; and a solvent containing moisture, the treatment ink at least including the UV-curable compound; the readily water-soluble compound; the solvent; and an auxiliary added to facilitate a process to dye the fabric using the coloring material, the dyeing step further comprising irradiating the textile printing ink applied to the fabric with ultraviolet light, the treatment step further comprising irradiating the treatment ink applied to the fabric with ultraviolet light.

2. The textile printing method according to claim 1, wherein the treatment step is a pretreatment step preceding the dyeing step.

3. The textile printing method according to claim 1, wherein the textile printing ink includes the UV-curable compound in a proportion from 20% to 60% by weight to a total weight of the textile printing ink.

4. The textile printing method according to claim 1, wherein the textile printing ink or the treatment ink includes the readily water-soluble compound in a proportion from 10% to 50% by weight to a total weight of the textile printing ink or the treatment ink.

5. The textile printing method according to claim 1, wherein the treatment ink includes the auxiliary in a proportion from 5% to 70% by weight to a summed weight of the UV-curable compound and the readily water-soluble compound.

6. The textile printing method according to claim 1, wherein the textile printing ink includes the coloring material in a proportion from 10% to 200% by weight to a summed weight of the UV-curable compound and the readily water-soluble compound after the textile printing ink is dried.

7. The textile printing method according to claim 1, further comprising a heating step of heating the textile printing ink and the treatment ink on the fabric to evaporate the solvents included in the textile printing ink and the treatment ink.

8. The textile printing method according to claim 2, wherein the textile printing ink includes the UV-curable compound in a proportion from 20% to 60% by weight to a total weight of the textile printing ink.

9. The textile printing method according to claim 2, wherein the textile printing ink or the treatment ink includes the readily water-soluble compound in a proportion from 10% to 50% by weight to a total weight of the textile printing ink or the treatment ink.

10. The textile printing method according to claim 2, wherein the treatment ink includes the auxiliary in a proportion from 5% to 70% by weight to a summed weight of the UV-curable compound and the readily water-soluble compound.

11. The textile printing method according to claim 2, wherein the textile printing ink includes the coloring material in a proportion from 10% to 200% by weight to a summed weight of the UV-curable compound and the readily water-soluble compound after the textile printing ink is dried.

12. The textile printing method according to claim 2, further comprising a heating step of heating the textile printing ink and the treatment ink on the fabric to evaporate the solvents included in the textile printing ink and the treatment ink.

* * * * *